US009272332B2

(12) United States Patent
Becker et al.

(10) Patent No.: US 9,272,332 B2
(45) Date of Patent: Mar. 1, 2016

(54) NEAR NET SHAPE MANUFACTURING OF RARE EARTH PERMANENT MAGNETS

(71) Applicant: GM Global Technology Operations LLC, Detroit, MI (US)

(72) Inventors: Edward P. Becker, Brighton, MI (US); Yucong Wang, West Bloomfied, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 802 days.

(21) Appl. No.: 13/628,490

(22) Filed: Sep. 27, 2012

(65) Prior Publication Data

US 2015/0251248 A1 Sep. 10, 2015

Related U.S. Application Data

(60) Provisional application No. 61/540,737, filed on Sep. 29, 2011.

(51) Int. Cl.

| | |
|---|---|
| ***B22F 3/08*** | (2006.01) |
| ***H01F 41/02*** | (2006.01) |
| ***H01F 1/057*** | (2006.01) |

(Continued)

(52) U.S. Cl.

CPC . *B22F 3/08* (2013.01); *C22C 33/02* (2013.01); *C22C 38/001* (2013.01); *C22C 38/005* (2013.01); *H01F 1/0577* (2013.01); *H01F 41/0266* (2013.01); *H01F 41/0273* (2013.01); *H01F 41/0293* (2013.01); *B22F 2998/00* (2013.01); *C22C 2202/00* (2013.01)

(58) Field of Classification Search

CPC ..... B22F 2999/00; B22F 3/08; B22F 3/087; H01F 1/0577; H01F 41/0246

See application file for complete search history.

(56) References Cited

U.S. PATENT DOCUMENTS

| | | | |
|---|---|---|---|
| 4,628,819 | A | 12/1986 | Backofen, Jr. et al. |
| 5,093,076 | A | 3/1992 | Young et al. |
| 5,139,720 | A | 8/1992 | Takeda et al. |

(Continued)

FOREIGN PATENT DOCUMENTS

| | | | |
|---|---|---|---|
| CN | 1066744 | A | 12/1992 |
| CN | 101911226 | A | 12/2010 |

(Continued)

OTHER PUBLICATIONS

Guruswarmy, Journal of Applied Physics, 1996, vol. 79, p. 4851-4853.*

*Primary Examiner* — Jie Yang
*Assistant Examiner* — Xiaowei Su
(74) *Attorney, Agent, or Firm* — Dinsmore & Shohl LLP

(57) ABSTRACT

A method of near net shaping a rare earth permanent magnet and a permanent magnet. The method includes introducing a magnetic material powder into a die, closing the die and shock compacting the powder in the die and sintering the compacted magnet powder to form the rare earth permanent magnet part. In one form, the magnetic material being subjected to compaction is a mixture made up of two or more different magnetic material powder precursors. Additional materials may be added to the mixture. One such additional material may be a lubricant to reduce the likelihood of cracking, while another may be a coating to provide oxidation protection of the mixture. Evacuation or inert environments may also be used either prior to or in conjunction with the sintering or related high-temperature part of the process.

20 Claims, 4 Drawing Sheets

(51) Int. Cl.
*C22C 33/02* (2006.01)
*C22C 38/00* (2006.01)

(56) References Cited

U.S. PATENT DOCUMENTS

| | | | | |
|---|---|---|---|---|
| 5,595,608 | A * | 1/1997 | Takebuchi | H01F 1/0577 148/103 |
| 5,666,635 | A * | 9/1997 | Kaneko | B22F 3/004 148/103 |
| 6,179,894 | B1 * | 1/2001 | Gay | B22F 1/025 419/10 |
| 6,251,196 | B1 * | 6/2001 | Nishiuchi | H01F 41/026 148/101 |
| 6,423,264 | B1 * | 7/2002 | Gay | B22F 7/06 148/100 |
| 6,432,554 | B1 | 8/2002 | Barber et al. | |
| 6,736,909 | B2 | 5/2004 | Waki et al. | |
| 6,811,887 | B2 | 11/2004 | Barber et al. | |
| 6,868,778 | B2 | 3/2005 | Knoth et al. | |
| 6,984,271 | B2 | 1/2006 | Tayu et al. | |
| 7,147,686 | B2 | 12/2006 | Tayu et al. | |
| 7,362,015 | B2 | 4/2008 | Barber et al. | |
| 7,390,579 | B2 * | 6/2008 | Guschl | H01F 1/0572 428/811.2 |
| 7,455,509 | B2 | 11/2008 | Knoth et al. | |
| 7,528,936 | B2 | 5/2009 | Gregerson et al. | |
| 7,559,996 | B2 | 7/2009 | Miyata et al. | |
| 7,601,403 | B2 | 10/2009 | Anselmi-Tamburini et al. | |
| 7,608,153 | B2 | 10/2009 | Tayu et al. | |
| 7,800,271 | B2 | 9/2010 | Komuro et al. | |
| 7,914,087 | B2 | 3/2011 | Alfthan | |

FOREIGN PATENT DOCUMENTS

| | | | | |
|---|---|---|---|---|
| CN | 102034583 | A | 4/2011 | |
| EP | 0195219 | A2 * | 9/1986 | B82Y 25/00 |
| JP | 2008038160 | A | 2/2008 | |

* cited by examiner

NEAR NET SHAPE MANUFACTURING OF RARE EARTH PERMANENT MAGNETS

This application claims priority to U.S. Provisional Application 61/540,737, filed Sep. 29, 2011.

BACKGROUND OF THE INVENTION

The present invention relates generally to forming permanent magnets for use in electric motors, and more particularly to including rare earth (RE) materials to improve magnetic properties of the formed magnets, as well as to use high-velocity compression techniques as a way to form magnets into shapes that require little or no post-formation machining.

Permanent magnets have been widely used in a variety of devices, including traction electric motors for hybrid and electric vehicles, wind mills, air conditioners and other mechanized equipment. One type of permanent magnet—sintered Nd—Fe—B type permanent magnets—contains RE metals such as dysprosium (Dy) or terbium (Tb) to improve the magnetic properties (such as intrinsic coercivity) of the magnets at high temperatures.

Known RE magnet manufacturing processes begin with the initial preparation, including inspection and weighing of the starting materials (iron, iron-neodymium alloy and boron, as well as iron-dysprosium alloys or the like) for the desired material compositions. The materials are then vacuum induction melted and strip cast to form thin pieces (less than one mm) of several centimeters in size. This is followed by hydrogen decrepitation where the thin pieces absorb hydrogen at about 25° C. to about 300° C. for about 5 to about 20 hours, dehydrogenated at about 200° C. to about 400° C. for about 3 to about 25 hours and then subjected to hammer milling and grinding and/or mechanical pulverization or nitrogen milling (if needed) to form fine powder suitable for further powder metallurgy processing. This powder is typically screened for size classification and then mixed with other alloying powders for the final desired magnetic material composition, along with binders to make green parts (typically in the form of a cube) through a suitable pressing operation in a die (often at room temperature). In one form, the powder is weighed prior to its formation into a cubic block or other shape. The shaped part is then vacuum bagged and subjected to isostatic pressing, after which it is sintered (for example, at about 900° C. to about 1100° C. for about 1 to about 30 hrs in vacuum) and aged, if needed, (for example, at about 300° C. to about 700° C. for about 5 to about 20 hours in vacuum). Typically, a number of blocks totaling about 300 kg to about 500 kg undergo sintering at the same time as a batch. The magnet pieces are then cut and machined to the final shape from the larger block based on the desired final shape for the magnets. The magnet pieces are then surface treated, if desired.

Normally with the powder metal process, the density of the green part is about 50 to 55 percent of the theoretical density, which results in significant shrinkage during sintering. If the green part is in cubic block form, the shrinkage is uniform. However, if the green part is not symmetric in shape, it will distort and warp in a manner that is typically difficult to control. To avoid this, the required magnets are usually machined from the block material; this process results in a relatively large amount of material loss, where the yield is typically about 55 to 65 percent (i.e., about 35 to 45 percent loss of the material). Other difficulties associated with the conventional powder metallurgy-based technique also arise. For example, the surfaces of the original large block are also subject to some oxidation, which may result in additional loss of material.

The high material loss during manufacturing has greatly increased the cost of the finished RE magnets. This cost has been exacerbated by a dramatic rise in the price of the raw RE metals in the past several years. As such, there are significant problems associated with accurately producing cost-effective magnets that contain RE materials.

SUMMARY OF THE INVENTION

One aspect of the invention is a method of near net shape manufacturing of RE permanent magnets. In one embodiment, the method includes introducing magnetic material powder into a die, shock compacting the powder in the die and sintering the compacted magnet powder to form the RE permanent magnet part. In one form, the powder (which may be a mixture or two or more separate powder precursors) includes at least one of Dy or Tb as a way to increase the elevated-temperature performance of the magnet.

Another aspect of the invention includes a method of shock compacting an RE permanent magnet. The method includes introducing an Nd—Fe—B powder and a powder containing at least one of Dy and Tb into a die, shock compacting the powders with the die and then sintering the compacted powder.

Yet another aspect of the invention includes method of forming an RE permanent magnet by introducing an Nd—Fe—B powder and a powder containing at least one of Dy and Tb into a die, compacting the powders through a high-velocity impact of the die with the powder such that at least some local surface melting of particles present in the powder takes place, and then sintering the compacted powder. The high velocity impact is capable of generating high pressure waves in a very short time in a manner similar to that of the aforementioned shock loading; this in turn tends to produce the localized melting.

BRIEF DESCRIPTION OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1A:
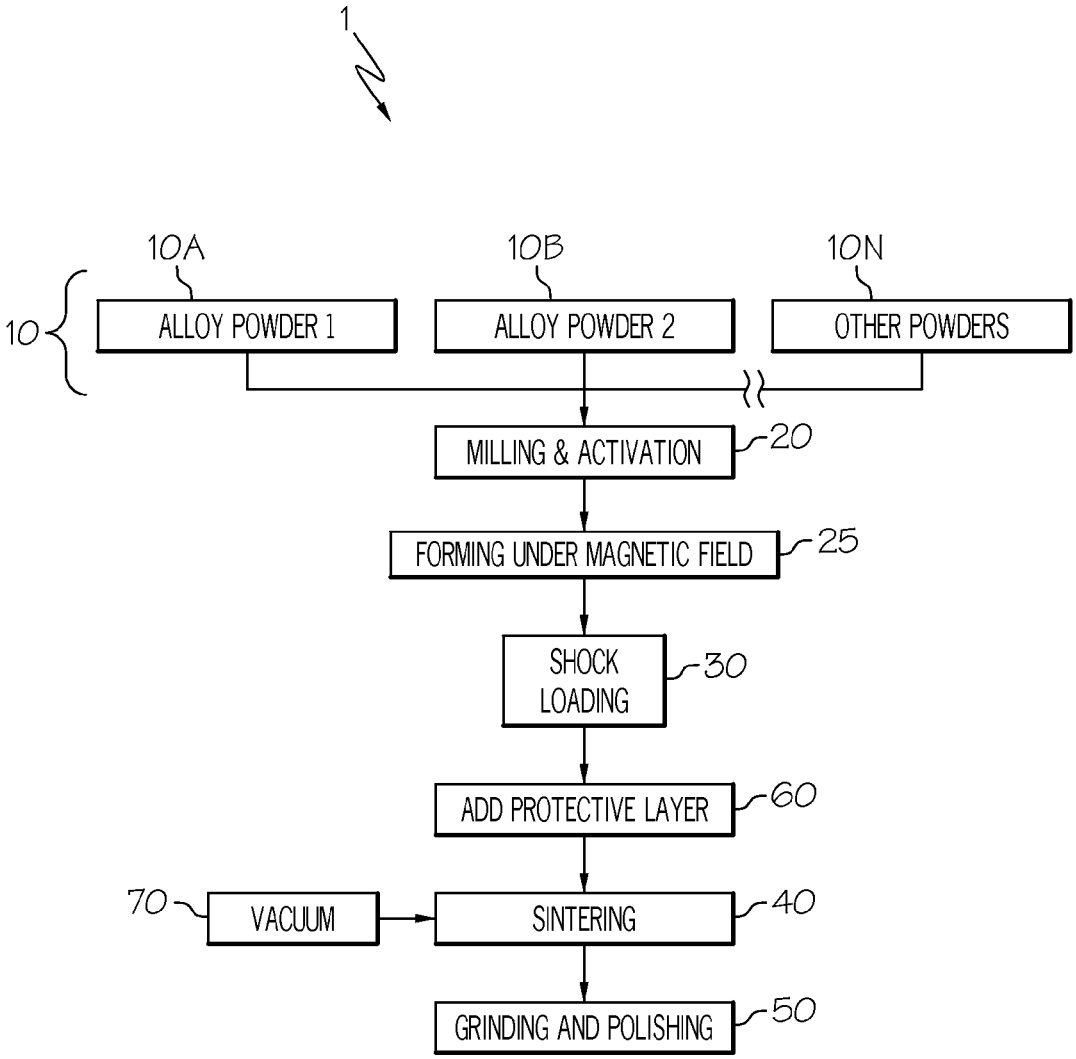
FIG. 1A is a flow diagram of the major steps in forming RE permanent magnets according to an aspect of the present invention.

The present invention pertains to a process for making RE permanent magnets in such a way that residual stress, distortion and surface oxidation are reduced. The process greatly reduces or eliminates the need for subsequent machining operations, as well as decreases the material loss during manufacturing, while still being capable of delivering high surface concentrations of Dy or Tb in the powders while keeping the overall (i.e., bulk) concentration low. By way of example, when such magnets are configured for use in an electric traction motor used to provide at least a portion of the propulsive force to a car or truck, the surface concentration may be on the order of 5 percent to 50 percent by weight, while the bulk concentration is between about 1 percent by weight and about 8 percent by weight. In this way, the bulk concentration represents a significant reduction over conventional Dy- or Tb-loaded Nd—Fe—B permanent magnets that typically employ between about 6 and 10 percent by weight Dy or Tb.

The process involves near-net shape manufacturing of RE magnets with minimal machining, yet in such a way that deformation or warping is reduced or eliminated. A small amount of a lubricant may be required to make green magnet parts as a way to prevent cracking of these green parts during compaction. In such cases, the lubricant is preferably used with an inorganic (for example, boron nitride, molybdenum disulfide or tungsten disulfide) or organic (for example, zinc stearate or a paraffinic wax) carrier, depending on the remaining processing parameters. In either configuration, the lubricant helps facilitate mixture densification without cracking.

As mentioned above, the use of high-velocity densification helps significantly improve green part density. For example, compared to previous green part density values of about 50 to 55 percent of theoretical density (or little over 60 percent after isostatic pressing), the present invention could lead to green parts with 65 or much higher percent of the theoretical density. This in turn leads to a final density after sintering of between about 95 to 99 percent, or more. As a result, the magnets produced by the process could have better magnetic and mechanical properties—especially fatigue strength—due to this higher density. The process time can be shorter than the conventional process, while the cost is lower. Furthermore, the process is not limited to small scale applications, and is capable of maintaining the original powder properties in the compact. Alloys can be produced with unique compositions, such as non-stoichiometric compositions and non-equilibrium structures.

As mentioned above, in one form the milling and blending of the powders are done with a small amount of a lubricant to help promote densification of the powders without cracking. The powders are fed into a die having the final magnet shape. The isostatic pressing step is replaced with close die compaction via shock loading or other high impact velocity process. The close die and shock compaction can be conducted at about room temperature (e.g., about 20° C. to 25° C.), although the compacted can reach a high temperature from the adiabatic effect in the die chamber. This high temperature can soften the powder material and make it easier to deform plastically, even for brittle materials such as ceramics, making the compaction possible.

The compacted green part is sintered in the vacuum furnace at about 900° C. to about 1200° C. for about 1 to 10 hours, after which the completed part undergoes a subsequent single- or double-step lower temperature aging heat treatment.

A coining process (warm or hot) may be added after sintering to reduce/eliminate distortion from residual stress, if desired. While coining is usually done at room temperature, the present inventors have determined that magnetic materials such as those discussed herein may be too brittle at room temperature for coining; as such, they have determined that elevated temperature coining (for example, between about 600° C. and about 750° C.) may be preferable. This should be done in vacuum or in an inert atmosphere (for example, $N_2$ or Ar) to prevent oxidation. In situations where post-sintering cutting and machining is not desired, alternative minor polishing (such as with silica sand, for example) may be performed, if desired.

The powders are compacted by a shock front that travels through the encapsulated powders. The shock waves produce high velocity impact (about 10 to about 1000 m/sec) at high pressure and in a very short time. The pressure could be about 150 to about 500 MPa, depending on the compaction equipment used. The shock loading is accomplished through movement of a compaction member (for example, a piston as will be discussed in more detail below) in response to a shock caused by compressed spring devices, electrohydraulic devices, electromagnetic devices, piezoelectric devices, explosive devices and electric gun devices. Preferably, the compacting takes place in a fraction of a second, and more particularly, fewer than ten microseconds. Under these high strain conditions, materials tend to deform plastically with a large amount of locally generated heat. The heat may even melt the powder material locally due to the adiabatic effect because there is not enough time for heat dissipation through heat transfer. As mentioned above, even ceramic materials powder precursors may be plastically-deformed by the high-strain rate deformation produced by the shock loading.

Referring first to FIG. 1A, a process route for producing RE permanent magnets according to an aspect of the present invention is shown. The process 1 includes blending 10 various constituent powders 10A, 10B to 10N that correspond to the number of materials needed to make up the magnet. For example, if the magnet being produced is based on a Nd—Fe—B configuration where at least some of the Nd is to be replaced by Dy or Tb, constituent powders 10A to 10N may include the aforementioned iron-based powder containing Dy or Tb, as well as an Nd—Fe—B-based powder. In one form (such as for the car or truck applications involving a traction motor discussed above), the finished RE permanent magnets will have Dy by weight about 8 or 9 percent, although it will be appreciated by those skilled in the art that other applications (such as wind turbines, where the bulk Dy or Tb concentration may need to be on the order of 3 to 4 percent by weight) may realize similar bulk concentration reductions, as will applications where these and other RE concentrations need to be greater. In any event, the use of permanent magnets in any such motors that could benefit from improved magnetic properties (such as coercivity) are deemed to be within the scope of the present invention.

It will likewise be appreciated by those skilled in the art that additional constituents—such as the binders and lubricants referred to above—may also be included into the mixture produced by blending 10, although such binders and lubricants should be kept minimum to avoid contamination or reductions in magnetic properties. Likewise, it will be appreciated by those skilled in the art that other steps may be used before, after or in conjunction with the blending 10 discussed above; these steps may include the melting, strip casting, hydrogen decrepitation, pulverizing, milling and screening discussed above. In one form, the blending 10 may include the use of an iron-based alloy powder of Dy or Tb (for example, between about 15 percent and about 50 percent by weight Dy or Tb) being mixed with an Nd—Fe—B-based powder.

The blending 10 may be followed by a milling and activation step 20, followed by close die compaction via shock loading 30 to produce a densified green part. From this, sintering 40 is used to promote metallurgical bonding through heating and solid-state diffusion. As such, sintering 40—where the temperature is slightly below that needed to melt the material—is understood as being distinct from other higher temperature operations that do involve melting. During sintering, it may be advantageous to maintain a vacuum (for example, about $10^{-3}$ Pa for a period between 2 and 8 hours, with a more specific range of 3 to 6 hours) in order to achieve 99 percent (or more) theoretical density. As will be understood by those skilled in the art, longer sintering 40 times can further improve the sintered density. Additional secondary operations after the sintering 40 may also be employed, including machining 50 as well as other steps (not shown) including repressing, coining, sizing, deburring, surface compressive peening, joining, tumbling or the like. Additional, oxidation-prevention steps may be employed, such as through the addition of an oxide or related coating in certain situations, such as where hot forging is used as one of the machining 50 steps after sintering 40.

Preferably, a magnetic field 25 is used to help form the material that was subjected to the milling and activation step 20. This takes place prior to (or in conjunction with) shock loading 30 to help promote alignment of the powder under a magnetic field (preferably between about 1.5 to 2 teslas). The magnetic field will cause the individual magnetic particles of the mixture to align so that the finished magnet will have a preferred magnetization direction.

In one form, the use of a lubricant (not shown) may help avoid cracking problems that may arise as a result of the high pressure inherent in the shock loading 30. For example, one of the alloy powders 10A to 10N may contain a lubricant, preferably in an amount up to about 2 percent by weight that may be admixed with the powder 10A to 10N prior to introduction into the die. The lubricant is preferably used with an inorganic (e.g. boron nitride, molybdenum disulfide, tungsten disulfide) or organic (e.g. zinc stearate or a paraffinic wax) carrier, depending on the remaining processing parameters.

As mentioned above, it is preferable to make small magnet parts rather than large blocks of material from which smaller pieces are then taken. In one form, the small magnet parts are roughly 2 centimeters in length, and about 5 millimeters in thickness, and are produced in near-net shape (which in one form may be generally linear, while in another, slightly arcuate). As oxidation is a concern with these parts, it is advantageous to perform at least some of the steps in an evacuated environment, such as that shown as vacuum 70 however, the heating and concomitant diffusion that accompanies the evacuation process tends to cause a loss of the RE materials from the surface. Because of this, a protective layer or coating 60 may be used to prevent such Dy or Tb depletion during sintering 40. In one form, the protective coating 60 is a ceramic coating configured to have high thermal insulation and oxidation-resistant properties. For example, a slurry made up of a mixture of ceramic and mineral particles suspended in an organic based (for example, ethanol or acetone) solution of sodium silicate may be used. In one form, the mixture may include (by weight) about 55 to 65 percent silica oxide, about 25 to 35 percent magnesia, about 2 to 8 percent kaolin and about 2 to 8 percent montmorillonite. About 20 to 40 percent of the solution by weight includes dissolved sodium silicate having a silica-to-sodium oxide molar ratio between about 2.5 and 3.8. In this way, the slurry contains by weight about 40 to 48 parts of the solution. This slurry may be used to coat the magnets, after which both are heated at a slow rate (for example, between about 1° C. per minute and 5° C. per minute) prior to sintering 40; in this way, complete dehydration of the sodium silicate is promoted, as are reactions between the ceramic particles and the sodium silicate. This slow heating could be done under vacuum in conjunction with sintering 40 as a way to save energy.

Care must be taken to ensure that any applied coating 60 is substantially devoid of any residual liquid or slurry presence before subjected to the furnace that is used along with vacuum 70 to provide heat treatment as a way to avoid volatility issues during subsequent sintering 40. As such, an approach (such as that discussed in the previous paragraph) used to place a protective coating 60 onto the magnets before sintering 40 to prevent the loss of surface elements such as Dy and other RE would employ an organic (rather than inorganic) solvent as a binder. In a preferred form, the coating 60 is applied via spray, preferably to a thickness of between about 10 and 500 microns as a way to reduce or eliminate the reaction of the RE elements during sintering 40, as well as to reduce or eliminate the release the RE elements into vacuum 70.

In a preferred form, the protective coating 60 is a temporary coating that may be removed (such as by blasting or the like) off after the sintering 40 and heat treatment that is used in conjunction with (or as part of) vacuum 70. Although the compound making up the protective layer is mentioned as containing sodium silicate, it will be appreciated by those skilled in the art that other ceramic-like substance that exhibits inert behavior at sintering temperatures may be used; a few such examples are aluminum oxide or dysprosium sulfide. Furthermore, some of the coating compositions could be permanently left on the magnets as an oxidation-resistance protective coating.

Figure 1B:
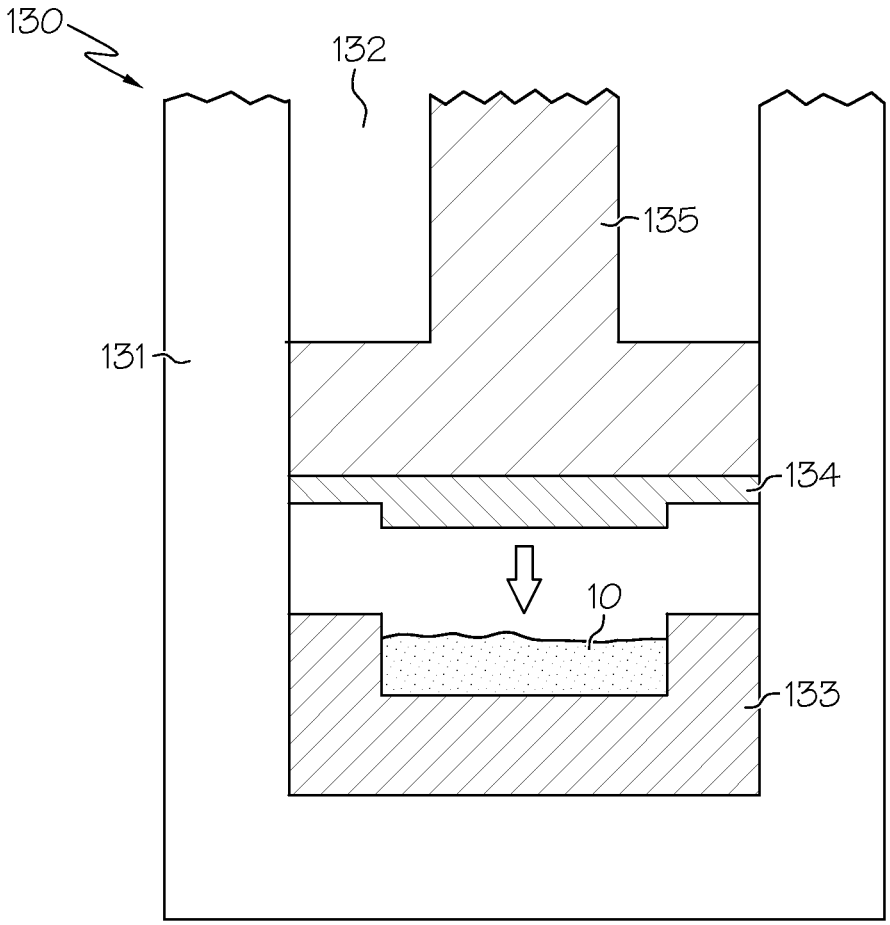
FIG. 1B is an illustration of compaction die used in the shock loading or related high-velocity impact portion of the process of FIG. 1A.

Referring next to FIG. 1B, the equipment used for the shock loading 30 part of the process 1 is in the form of a compaction die 130 for producing shock wave compaction. The compaction die 130 includes a housing 131 forming a chamber 132. There is a stationary lower die 133 and a movable upper die 134. The movable upper die 134 is positioned on a compaction piston 135 that is in turn responsive to a detonation, spring or other medium (not shown) used to impart high-speed movement upon compaction piston 135. The powdered material produced by the blending 10 is placed in the lower die 133 such that a shock wave imparted to the powdered material from the compaction piston 135 forms a near net shape dense green part.

With shock loading compaction, planar shock waves are preferred for their ability to provide controlled waves, and, as a result, maximum and uniform compaction through the part being compacted. In the case of explosive, evaporated aluminum foil (under high voltage and large current), or released spring driven shock loading, the loading is initiated at the top of the compaction die 130, and shock waves are allowed to run down the length of the powder 10 being compressed. The shock front compacts the powder encapsulated between upper and lower dies 134, 133 into a solid form. The pressure exerted by the shock front is usually much greater than the shear stress of the powder 10 being compacted. This causes plastic deformation of the powder 10, and the densification of the compact due to the plastic flow of the material and the collapsing of voids. Particle-particle friction, deformational heat and the high velocity impact of individual particles caused by the shock front lead to the bonding of particles to adjacent particles such that compacts with close to theoretical density can be fabricated. Thus, the final magnet density produced may be at least about 95 percent of theoretical density, or at least about 96 percent, or at least about 97 percent, or at least about 98 percent, or at least about 99 percent, all of which approach the theoretical density of about 7.5 g/cm$^3$.

Shock compaction has a number of advantages compared with conventional pressing methods. For example, it is not limited to small scale applications, and the original powder properties can be maintained in the compact. Parts can be produced with unique compositions (including non-stoichiometric compositions) and non-equilibrium structures. Likewise (as mentioned above), accompanying adiabatic heat generation may help provide local melting of powders, thereby being usable with material precursors (such as ceramics) that otherwise might not be compatible.

With explosive shock compaction, a layer of sacrificial metal may be placed between the powder 10 and the explosive. In one form, this layer may be made from a sheet made of steel or another metal. In another form, it can be a part of the die 130, depending on the part geometry. For the spring releasing mechanism, a part of die 130 may be needed between the powder 10 and the spring (not shown).

Typically, the shock loading process uses only one stroke and one die and produces one or multiple parts. However, multiple strokes can be used, if needed. This is especially true for using a spring releasing shock loading machine.

As stated above in conjunction with FIG. 1A, once the part has gone through the shock loading 30, it can be subjected to sintering 40 to improve its density and strength. As mentioned above, the part is typically heated at a slow rate of about 1° C./min to 5° C./min to a temperature within a range of between about 900° C. and about 1200° C. for between about 1 and 10 hours. More particularly, the heating rate may be between about 2° C./min and 5° C./min. Aging can be done in conjunction with sintering. As such, an average sintering temperature is about 1050° C., with a typical sintering and aging time of about 5 to 30 hours. Typical sintering vacuum is in the range of about $10^{-3}$ and about $10^{-5}$ Pascals. These longer sintering times can significantly improve the sintered density, while the slow heating rates promote complete dehydration of the slurry materials. As with other forms of powder metallurgy processing, a cooling schedule may be used, where the sintered and compacted component is cooled over the course of numerous hours.

The compaction die 130 can be made from a hot work tool steel (such as D2 steel), stainless steel, a tungsten alloy, a Ni-based superalloy, or other material with high strength at high temperature.

Figure 2A:
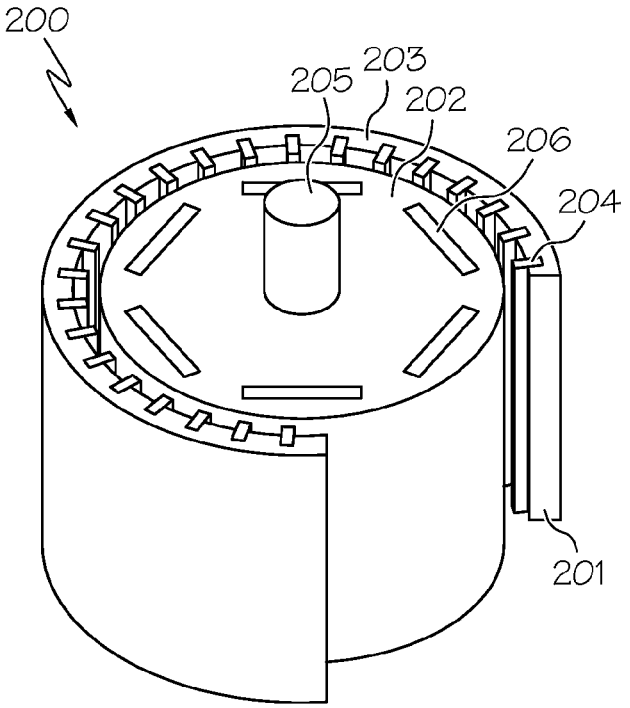
FIGS. 2A and 2B show a comparison between a simplified permanent magnet-based motor configuration (FIG. 2A) and a simplified induction-based motor configuration (FIG. 2B), as well as a representative placement in the former of the magnets that are compacted using the die of FIG. 1B.
Figure 2B:
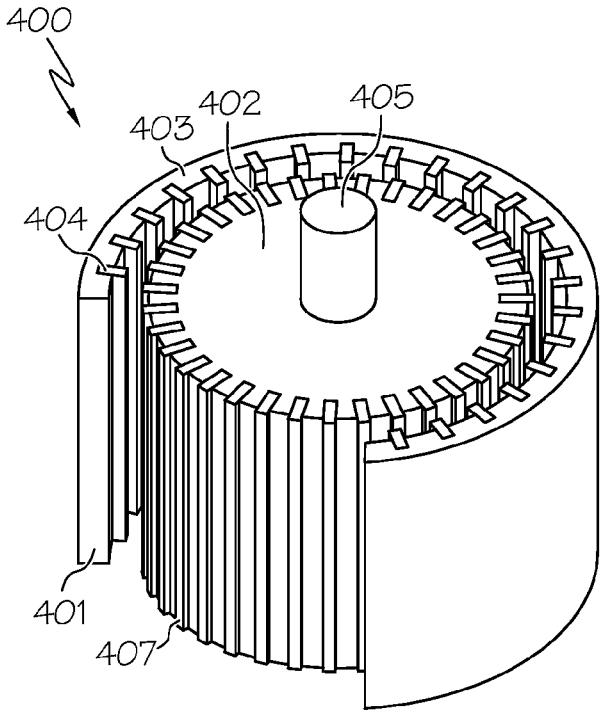
Figure 3:
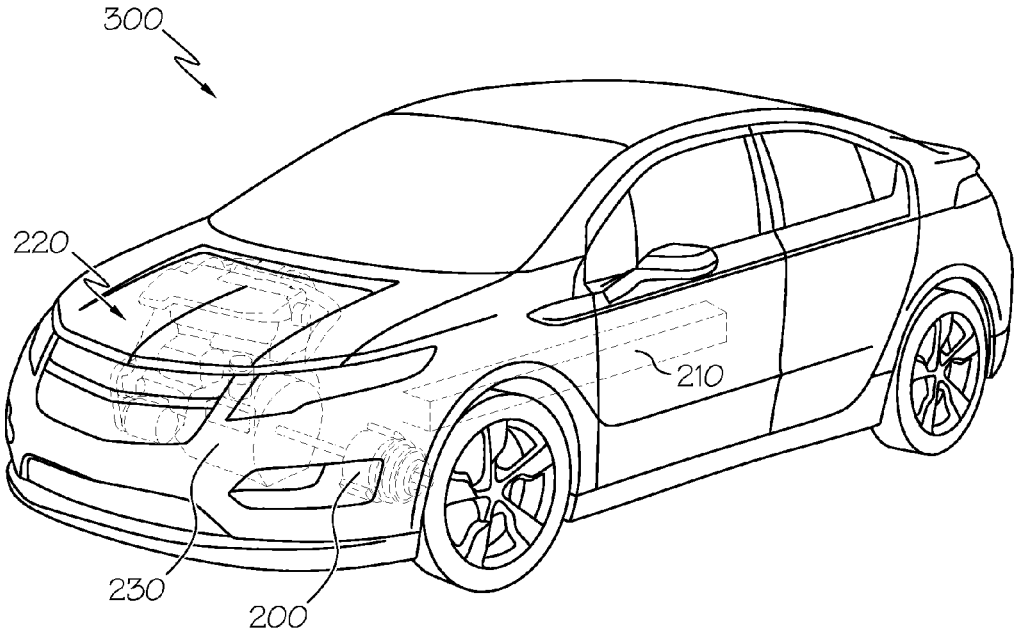
FIG. 3 shows a vehicle that incorporates a hybrid propulsion system that includes the permanent magnet-based electric motor using magnets made in accordance with the present invention.

Referring next to FIGS. 2A, 2B and 3, a portion of a permanent magnet electric motor 200 (FIG. 2A) and a vehicle 300 using such a motor 200 are shown, while for comparison purposes an induction motor 400 (FIG. 2B) is additionally shown. In the present form, vehicle 300 is configured as hybrid-powered (also known as a hybrid electric vehicle (HEV) or extended range electric vehicle (EREV) that is part of a larger class of vehicles referred to as electric vehicles (EVs)), where the motor 200 cooperates with a fuel cell (not shown) or a battery pack 210 to deliver propulsive power to the wheels of vehicle 300. A traditional internal combustion engine (ICE) 220 may also be used; such an engine may be directly coupled to a drivetrain to deliver power to the wheels, or may be coupled to motor 200 in order to convert shaft horsepower to electric power. Referring with particularity to FIG. 2A, a cutaway view along the axial dimension of motor 200 shows a stator 201 made from a magnetically-compatable material (for example, iron) and a rotor 202. Stator 201 defines a plurality of radially-extending teeth 203 that provide support for numerous armature windings 204. In a notional embodiment, the number of teeth 203 help define a structure that gives rise to a multi-phase configuration, depending on the number of armature windings 204. It will be appreciated by those skilled in the art that the current-carrying wires that make up the windings 204 define traditional U-phase, V-phase and W-phase configurations) that can be wrapped around teeth 203. Numerous RE permanent magnets 206 are arranged around the periphery of rotor 202 such they are in magnetic communication with the field produced by the windings on stator 201.

Moreover, a comparison of permanent magnet motor 200 and an induction motor 400 highlights where in the former permanent magnets 206 made in accordance with the present invention may be employed. The induction motor 400 uses a rotor 402 with rotor windings 407 that cooperate with comparable windings 404 in stator 401 such that changes in current in windings 404 induce rotational movement in rotor 402 and shaft 405. It will be appreciated by those skilled in the art that the motor depicted in FIG. 3 may be suitably configured to function as a permanent magnet motor. In an alternate configuration (not shown) of the device depicted in FIG. 2A, the permanent magnets 206 may, instead of being formed in rotor 202, be formed in stator 201; it will be appreciated by those skilled in the art that either variant is suitable for use with the magnets 206 made in accordance with the present invention.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method of near net shape forming a rare earth permanent magnet, said method comprising:

introducing a plurality of magnetic material powders into a die;

mixing said plurality of powders to produce a blended powder;

shock compacting the blended powder in said die to produce a compacted powder;

adding a protective layer to the compacted powder to reduce oxidation of said compacted powder; and sintering the compacted powder subsequent to adding the protective layer.

2. The method of claim 1, wherein said protective layer is a ceramic-based slurry.

3. The method of claim 2, wherein said slurry and said compacted powder are heated at a rate between 1° C./minute and 5° C./minute.

4. The method of claim 1, further comprising subjecting said compacted powder to one of an evacuated atmosphere or an oxidatively inerted atmosphere.

5. The method of claim 1, wherein the shock compacting is produced by an electrohydraulic process, an electromagnetic process, a spring releasing process, a piezoelectric process, an explosion process, an electric gun process or combinations thereof.

6. The method of claim 5, wherein a layer of metal is disposed between said magnetic material powder and an explosive prior to said shock compacting by said explosion process.

7. The method of claim 1, wherein a density of the compacted powder is at least about 90 percent of a theoretical density.

8. The method of claim 1, wherein the rare earth permanent magnet has a non-stoichiometric composition.

9. The method of claim 1, further comprising surface treating the rare earth permanent magnet.

10. The method of claim 1, further comprising adjusting powder alignment of said blended powder in the presence of a magnetic field.

11. The method of claim 1, further comprising cooling the sintered powder in said die.

12. The method of claim 1, wherein sintering the compacted magnetic material powder comprises heating at a rate of about 1° C./min to about 5° C./min to a temperature within a range of about 900° C. to about 1200° C. for between about 1 to about 10 hr.

13. The method of claim 1, wherein the shock compaction is performed at a temperature of about 20° C. to about 25° C.

14. The method of claim 1, wherein the compacted magnetic material powder is sintered in a second die that is different from said die.

15. The method of claim 1, wherein said at least one of said plurality of powders comprises at least one of dysprosium and terbium such that prior to said shock compacting, said at least one of dysprosium and terbium is present in said rare earth magnetic material powder in an amount of between about 1 weight percent and about 9 weight percent.

16. A method of shock compacting a rare earth permanent magnet, said method comprising:

introducing a mixture of a neodymium-iron-boron powder and a powder containing at least one of dysprosium and terbium into a die;

using a magnetic field to preferentially align at least one of said neodymium-iron-boron powder and said powder containing at least one of dysprosium and terbium;

shock compacting the powders to produce a compacted powder;

adding a protective layer to the compacted powder to reduce oxidation of said compacted powder; and sintering the compacted powder.

17. The method of claim 16, wherein said mixture further comprises a lubricant in a quantity of up to about 2 percent by weight.

18. The method of claim 17, wherein said lubricant is inorganic-based that comprises at least one of boron nitride, molybdenum disulfide and tungsten disulfide.

19. The method of claim 17, wherein said lubricant is organic-based that comprises at least one of zinc stearate and a paraffinic wax.

20. The method of claim 17, further comprising a secondary operation selected from the group consisting of machining, repressing, coining, sizing, deburring, surface compressive peening, joining and tumbling.

* * * * *